US009518417B2

(12) United States Patent
Serban et al.

(10) Patent No.: US 9,518,417 B2
(45) Date of Patent: Dec. 13, 2016

(54) VEHICLE CLOSURE OBSTACLE DETECTION SYSTEMS AND METHODS

(71) Applicant: GM GLOBAL TECHNOLOGY OPERATIONS LLC, Detroit, MI (US)

(72) Inventors: Doru N. Serban, Richmond Hill (CA); Khristopher S. Lee, Oakland Township, MI (US); Shawn G. Quinn, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 43 days.

(21) Appl. No.: 14/466,578

(22) Filed: Aug. 22, 2014

(65) Prior Publication Data

US 2016/0053524 A1 Feb. 25, 2016

(51) Int. Cl.

| | |
|---|---|
| ***E05F 15/73*** | (2015.01) |
| ***E05F 15/43*** | (2015.01) |
| ***E05F 15/603*** | (2015.01) |
| ***E05F 15/611*** | (2015.01) |

(52) U.S. Cl.

CPC ..... *E05F 15/73* (2015.01); *E05F 15/43* (2015.01); *E05F 15/603* (2015.01); *E05F 15/611* (2015.01); *E05F 2015/432* (2015.01); *E05F 2015/434* (2015.01); *E05Y 2400/66* (2013.01); *E05Y 2400/80* (2013.01); *E05Y 2900/50* (2013.01); *E05Y 2900/546* (2013.01)

(58) Field of Classification Search

None

See application file for complete search history.

(56) References Cited

U.S. PATENT DOCUMENTS

2002/0179822 A1* 12/2002 Breed ..... B60J 7/0573 250/221

* cited by examiner

*Primary Examiner* — Mussa A Shaawat
*Assistant Examiner* — Kyung Kim
(74) *Attorney, Agent, or Firm* — Lorenz & Kopf, LLP

(57) ABSTRACT

An obstacle detection system of a vehicle includes a first group of transceivers mounted on the first closure structure and a second group of transceivers mounted on the second closure structure. A controller is configured to, during the first mode, command the first group of transceivers to generate a first signal, command, upon receiving the first signal, the second group of transceivers to generate a second signal to be received by the first group of transceivers, and determine a presence or absence of an obstacle based on the second signal. The controller is configured to, during the second mode, command the first group of transceivers to generate a third signal such that the third signal is reflected off the second closure structure as a fourth signal to be received by the first group of transceivers, and determine the presence or absence of the obstacle based on the fourth signal.

20 Claims, 5 Drawing Sheets

VEHICLE CLOSURE OBSTACLE DETECTION SYSTEMS AND METHODS

TECHNICAL FIELD

The technical field generally relates to vehicle systems and methods, and more particularly relates to vehicle systems and methods that detect obstacles between a closure and closure frame on the vehicle.

BACKGROUND

Generally, vehicle closures are designed to protect vehicle contents and allow for ingress and egress. The closures are generally mounted on the vehicle body to be pivoted between open and closed positions. The size, weight, geometry, and opening trajectory of the closure will vary from vehicle to vehicle and from closure to closure. Such closures may include driver and passenger doors, rear lift gates, and the like.

As with any closing portal, it is possible for an obstacle to be interposed between the closure and the closure frame. Depending on the size, weight, geometry, and trajectory range for opening, inadvertent contact between the closure and undetected obstructions may be possible, particularly when the closure is pivoting closed. Sport utility vehicles ("SUVs") and other large vehicles tend to have doors or rear lift gates with large openings angles, which exacerbates the potential for inadvertent contact.

It would be desirable to detect an obstacle to reduce the likelihood of inadvertent impact. Some mechanisms for detecting obstacles within the closure range of motion typically involve pressure or contact switches or sensors. However, such systems usually require contact with the switch or sensor to detect the presence of an obstacle. Although the contact in these systems may prevent or mitigate damage, it would be more desirable to avoid any contact. Additionally, there are issues regarding where and how to position the contact sensors, thus adding to the complexity and cost of design and/or manufacture. Moreover, a noncontact safety system may enhance the perception of luxury and technological exclusivity.

Accordingly, it is desirable to provide improved systems and methods for detecting obstacles in the path of a vehicle closure. Furthermore, other desirable features and characteristics of the present invention will become apparent from the subsequent detailed description and the appended claims, taken in conjunction with the accompanying drawings and the foregoing technical field and background.

SUMMARY

In accordance with an exemplary embodiment, an obstacle detection system is provided for a closure assembly of a vehicle with a first closure structure and a second closure structure that define a closure path. The obstacle detection system includes a first group of transceivers mounted on the first closure structure; a second group of transceivers mounted on the second closure structure; and a controller coupled to the first and second groups of transceivers and configured to selectively operate the first and second groups of the transceivers in a first mode or a second mode based on an angle of opening of the closure assembly. The controller is configured to, during operation in the first mode, command the first group of transceivers to generate a first signal across the closure gap toward the second group of transceivers, command, upon the second group of transceivers receiving the first signal, the second group of transceivers to generate a second signal to be received by the first group of transceivers, and determine a presence or absence of an obstacle in the closure path based on the second signal. The controller is configured to, during operation in the second mode, command the first group of transceivers to generate a third signal across the closure gap such that the third signal is reflected off the second closure structure as a fourth signal to be received by the first group of transceivers, and determine the presence or absence of the obstacle in the closure path based on the fourth signal.

In accordance with an exemplary embodiment, a closure assembly is provided. The closure assembly includes a first closure structure; a second closure structure arranged relative to the first closure structure to define a closure path; a first group of transceivers mounted on the first closure structure; a second group of transceivers mounted on the second closure structure; and a controller coupled to the first and second groups of transceivers and configured to selectively operate the first and second groups of the transceivers in a first mode or a second mode based on an angle of opening between the first and second closure structures. The controller configured to, during operation in the first mode, command the first group of transceivers to generate a first signal across the closure gap toward the second group of transceivers, and command, upon the second group of transceivers receiving the first signal, the second group of transceivers to generate a second signal to be received by the first group of transceivers, and determine a presence or absence of an obstacle in the closure path based on the second signal. The controller is configured to, during operation in the second mode, command the first group of transceivers to generate a third signal across the closure gap such that the first signal is reflected off the second closure structure as a fourth signal to be received by the first group of transceivers, and determine the presence or absence of the obstacle in the closure path based on the fourth signal.

DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Figure 1:
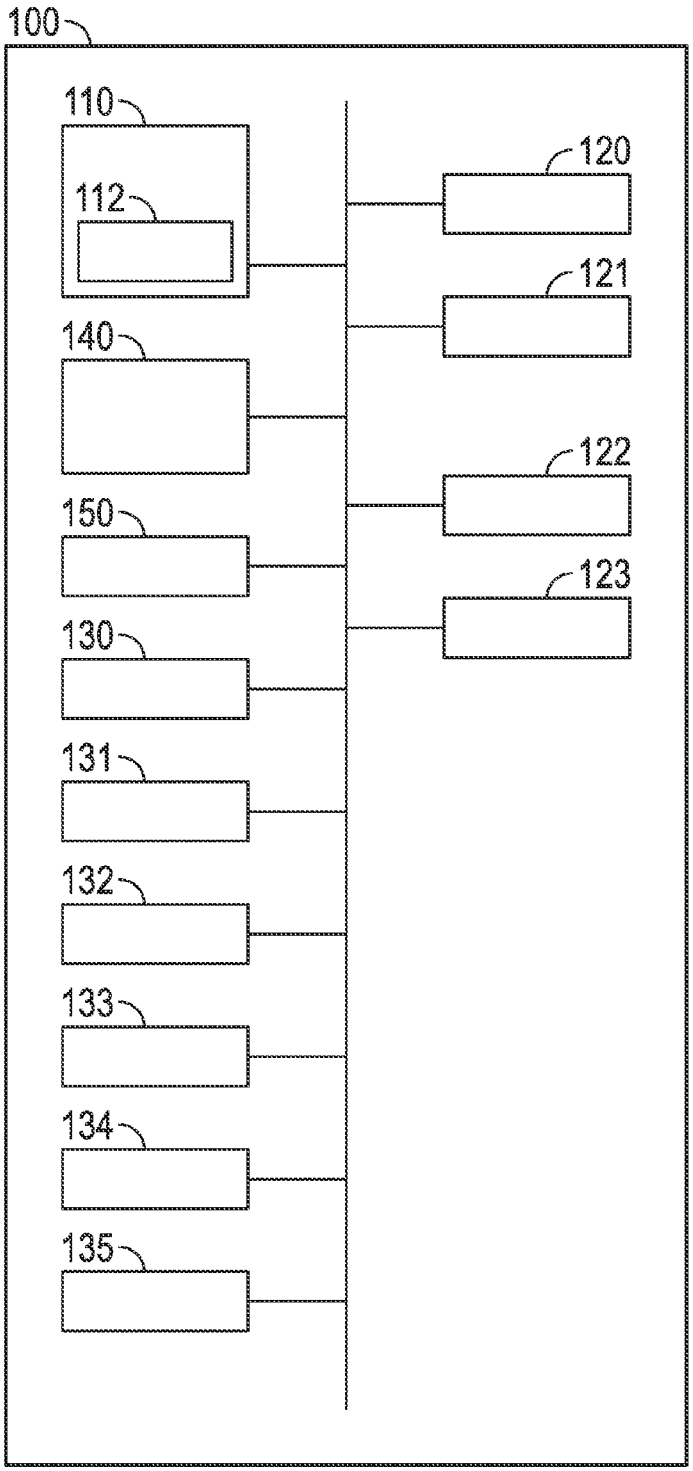
FIG. 1 is a schematic block diagram of an obstacle detection system for a closure of a vehicle in accordance with an exemplary embodiment.

FIG. 1 is a schematic block diagram of an obstacle detection system 100 for a closure of a vehicle in accordance with an exemplary embodiment. In general and as discussed in greater detail below, the system 100 functions to detect an obstacle in the closure path as the closure is being closed, e.g., between the closure and the closure frame on the vehicle body. The obstacle may be any type of object foreign to the vehicle, including a person or body part, as well as inanimate objects such as poles and garage walls. Upon detection of the obstacle, the system 100 may selectively initiate a number of possible responses or take no action, depending on the circumstance. Such responses may include a warning for a user, an active reversal of the closure, the stopping of the closure, or other suitable action, as will be discussed below. In the discussion below, the term "user" generally refers to anyone in the proximity of the closure during operation.

Generally, the system 100 may be incorporated into any type of vehicle and any type of closure on a vehicle. Examples of such closures include vehicle driver and passenger side doors, truck tail gates, swing doors or trunk lids, engine hoods, sliding side doors, winged doors, and the like. In the examples discussed below, the system 100 is associated with a rear door or lift gate on a sport utility vehicle ("SUV").

As shown in FIG. 1, the obstacle detection system 100 includes a controller 110, two or more transceivers 120-123, 130-135, a closure actuation unit 140, and a warning unit 150. The controller 110, transceivers 120-123, 130-135, closure actuation unit 140, and warning unit 150 may be operatively coupled together in any suitable manner, including on a wired or wireless configurations. In one exemplary embodiment, one or more components of the system 100 may communicate with an appropriate short range wireless data communication scheme, such as IEEE Specification 802.11 (Wi-Fi), WiMAX, the BLUETOOTH™ short range wireless communication protocol, a Dedicated Short Range Communication (DSRC) system, or the like, including cellular communications. Although not shown, the system 100 may be coupled to a power source, such as a vehicle battery, and may be incorporated into or otherwise cooperate with other vehicle systems. Each component will be introduced below prior to a more detailed discussion of the operation of the system 100.

The controller 110 is generally configured to carry out the functions described below, including controlling operation of the transceivers 120-123, 130-135, closure actuation unit 140, and warning unit 150. As such, the controller 110 generally represents the hardware, software, and/or firmware components configured to facilitate operation. In one exemplary embodiment, controller 110 may be an electronic control unit (ECU) of the vehicle. Depending on the embodiment, the controller 110 may be implemented or realized with a general purpose processor, a content addressable memory, a digital signal processor, an application specific integrated circuit, a field programmable gate array, any suitable programmable logic device, discrete gate or transistor logic, processing core, discrete hardware components, or any combination thereof. In practice, the controller 110 includes processing logic stored in memory that may be configured to carry out the functions, techniques, and processing tasks associated with the operation of the system 100. As an example, the controller 110 stores or otherwise accesses closure signal maps 112. As described below, the signal maps 112 correspond to signal patterns or responses associated with the closure and/or closure frame based on a closure angle and/or position.

In some embodiments, the controller 110 may be associated with a user interface that enables a user to interact with the system 100. Any suitable user interface may be provided, including a touch screen and/or combination of buttons and switches. In one exemplary embodiment, the user interface enables the user to disable or enable the system 100. In further embodiments, the user interface enables the user to define the conditions and consequences upon detection of an obstacle, as described in greater detail below. In other embodiments, the ability to make such selections may be omitted, e.g., to prevent a user from inadvertently disabling the system 100.

As described below, the transceivers 120-123, 130-135 function as short range sensors to send and receive signals that provide information about the area between the transceivers 120-123 on the closure and the transceivers 130-135 on the closure frame, e.g., within the closure path or trajectory. This information may be used to detect obstacles within the closure path. Any type of transceiver may be provided. However, in one particular embodiment, the transceivers 120-123, 130-135 send and receive infrared (IR) signals that are evaluated to detect the presence of an obstacle. Each transceiver 120-123, 130-135 may send and receive signals as narrow range beaming or narrow field detection. In some embodiments, other types of noncontact transceivers may be provided, including laser or ultrasonic transceivers. In some embodiments, IR transceivers may provide a particular robust and cost effective solution. In other embodiments, laser transceivers may result in higher operational performance, albeit at a higher price.

Each transceiver 120-123, 130-135 includes a transmitter and a receiver, typically formed as a unit with common circuitry and housing. In some embodiments, each transceiver 120-123, 130-135 corresponds to a transmitter and receiver, in combination, that do not share circuitry and/or housing but that are in close proximity to one another and paired. Generally, each transceiver 120-123, 130-135 is selectively controllable by the controller 110 to send and/or receive signals in a predetermined manner according to one or more modes, as described below.

In some exemplary embodiments, the transceivers 120-123, 130-135 may be grouped into one or more groups and/or sub-groups. For example, as also described below, the transceivers 120-123 are arranged on the closure and are pointed towards the closure frame. In one exemplary embodiment, the transceivers 120-123 are arranged in one or more vertical rows on one or both edges of the closure. In the discussion below, the transceivers 120-123 may be referred to as "closure" transceivers 120-123.

Moreover, in one exemplary embodiment, the closure transceivers 120-123 may be sub-grouped into a first sub-group 120, 121 and a second sub-group 122, 123. In such a sub-grouping, the first sub-group of closure transceivers 120, 121 may be positioned in a vertical row along a first side edge of the closure (as viewed when the closure is closed), and the second sub-group of closure transceivers 122, 123 may be positioned in a vertical row along a second side edge of the closure (as viewed when the closure is closed). Each group of closure transceivers 120-123 generally includes at least two transceivers, although additional transceivers may be added to each group.

Continuing the example, transceivers 130-135 are arranged on the closure frame and are pointed towards the closure. In one exemplary embodiment, the transceivers 130-135 are arranged in one or more vertical rows on one or both edges of the closure frame. In the discussion below, the transceivers 130-135 may be referred to as "frame" transceivers 130-135. As above, in one exemplary embodiment, the frame transceivers 130-135 may be sub-grouped into a first sub-group 130-132 positioned in a vertical row along the first side edge of the closure frame and the second sub-group of frame transceivers 133-135 may be positioned in a vertical row along the second side edge of the closure frame. Each group of frame transceivers 130-135 generally includes at least two transceivers, although additional transceivers may be added to each group.

In the discussion below, the first sub-group of closure transceivers 120, 121 may selectively interact with the first sub-group of frame transceivers 130-132, and the second sub-group of closure transceivers 122, 123 may selectively interact with the second sub-group of frame transceivers 133-135. Additionally, although not shown, additional sensors may be provided, such as inertial sensors to provide positional information regarding the closure, as well as LVDT sensors, GPS sensors, and the like. In one exemplary embodiment, individual transmitters and individual receivers (e.g., unpaired as an effective or functional transceiver) do not form part of the system 100.

Generally, the closure actuation unit 140 is configured to actuate the opening and closing of the closure. As such, the closure actuation unit 140 may include a motor that selectively assists or drives the closing or opening of the closure based on commands from the controller 110. To control movement of the closure, the closure actuation unit 140 may include any suitable coupling components, including fluid, magnetic, friction, and/or electric devices. In some embodiments, the closure actuation unit 140 may be associated with a user interface, such as a door handle, button, or a key fob remote, that enables the user to command the opening and closing of the closure via the controller 110.

In some embodiments, the closure actuation unit 140 may not actively assist closing the closure. Instead, the closure actuation unit 140 may merely function to stop or slow the closing of the closure. In further embodiments, the closure actuation unit 140 may be completely omitted. Accordingly, as discussed below, the user may initiate the closing of the closure via the closure actuation unit 140, and if the system 100 detects an obstacle in the closure path, the closure actuation unit 140 may be commanded to stop or modify operation. The closure actuation unit 140 may also detect or determine position information regarding the closure, including the angle between the closure and the closure frame, and provide this position information to the controller 110.

The warning unit 150 is configured to provide a warning to the user based on signals from the controller 110. The warning unit 150 may be any type of device that generates a message to the user. For example, the warning unit 150 may be a display device that renders various visual images (textual, graphic, or iconic) within a display area in response to commands received from the controller 110. Such a display device may be implemented in any suitable manner on or near the closure and realized using a liquid crystal display (LCD), a thin film transistor (TFT) display, a plasma display, a light emitting diode (LED) display, or the like. In further embodiments, the warning unit 150 may be an acoustical device that outputs an audible warning signal to the user, or the warning unit 150 may be a haptic device that vibrates to provide a signal to the user. Other visual warnings may include, for example, a visual projection of a warning on the back window or a flash sequence of brake lights.

As discussed in greater detail below, the warning unit 150 provides a warning to the user when the system 100 detects an obstacle within the path of the closure. Such warnings may enable the user to remove or address the obstacle. In some embodiments, the closure actuation unit 140 may be considered part of the warning unit 150 in that stopping or reversing the closure provides a warning to the user. In some embodiments, the warning unit 150 may be omitted and/or incorporated into the closure actuation unit 140.

During operation, the system 100 may be activated upon initiation of closing the closure. As such, the controller 110 may receive a signal that the user is attempting to close the closure. Typically, the user initiates the closing of the closure by placing a downward or inward force on the closure. In other embodiments, the user may initiate closure by activating a handle or remote user interface. In any event, when the closure is being closed, the transceivers 120-123, 130-135 cooperate to send signals across the closure path and receive returned signals, which are provided to the controller 110. As described below, the sending and receiving of the signals by the transceivers 120-123, 130-135 may vary based on the mode, typically in dependence on the current angle of opening between the closure and the closure frame. The controller 110 compares the returned signals to expected signals represented in the maps 112. If the returned signals do not match the expected signals, the controller 110 may conclude that an obstacle is between the closure frame and the closure. Upon detection of the obstacle, the controller 110 may generate a warning via the warning unit 150 and/or stop or reverse operation of the closure via the closure actuation unit 140. Additional details regarding operation of the system 100 are provided below.

Figure 2:
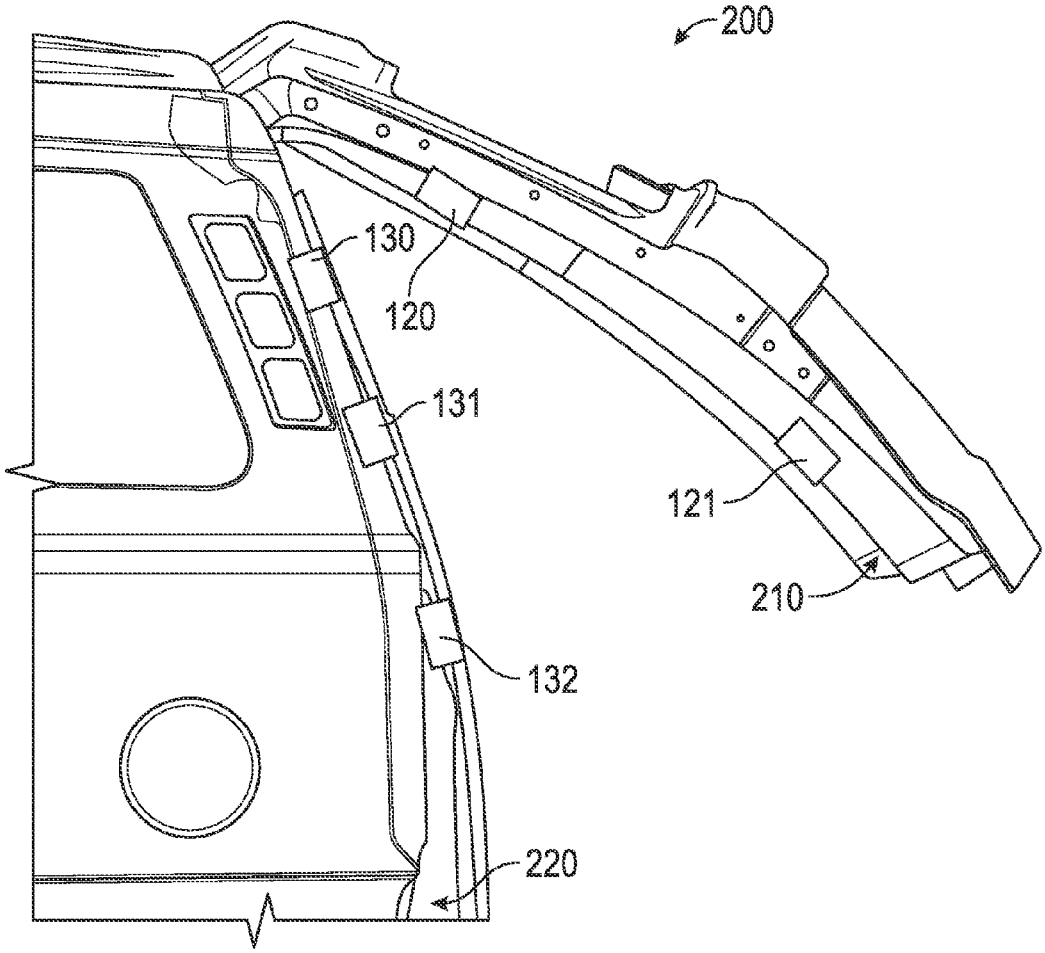
FIG. 2 is a partial, schematic side view of the vehicle associated with the obstacle detection system of FIG. 1 in accordance with an exemplary embodiment.

FIG. 2 is a partial, schematic side view of the obstacle detection system 100 of FIG. 1 incorporated into a vehicle 202 in accordance with one embodiment. FIG. 1 is also referenced below in the description of FIG. 2. As shown in FIG. 2, a closure 210 of the vehicle 202 is mounted on a closure frame 220. In the depicted embodiments, the closure 210 is open relative to the closure frame 220 at an opening angle 230 that varies based on the position of the closure 210. In the discussion below, the area between the closure 210 and closure frame 220 is referred to as the closure path or trajectory. Collectively, the system 100, closure 210, and/or the closure frame 220 may be referred to as a closure assembly 200, and broadly, the closure 210 and/or closure frame 220 may be referred to as closure structures. In the embodiments of FIG. 2, the closure 210 is a rear door or gate for an SUV or van. However, as noted above, exemplary embodiments of the system 100 are also applicable to other types of closures.

Although not shown in detail, typically, the closure 210 is pivotably mounted on the closure frame 220 with a hinge. The closure 210 may include a shell defined by inner and outer panels that enclose various components of the closure 210 and may further include one or more windows and window frames, as is typical in the art. Further, the closure 210 may include a latching mechanism for securement in a closed position and/or to initiate opening. Generally, the closure frame 220 is the portion of the vehicle body that defines the opening and cooperates or mates with the closure 210 to selectively provide access or seal that opening. In the depicted exemplary embodiment, the closure frame 220 corresponds to a D-pillar, although in other embodiments, the closure frame 220 may refer to other portions of the frame. As described above, the closure actuation unit 140 may be incorporated into or otherwise cooperate with the closure 210 and/or closure frame 220 to assist the opening and closing of the closure 210, as well as to carry out the responses discussed below when the system 100 detects an obstacle in the path or trajectory of the closure 210.

In the view of FIG. 2 and referencing the discussion above, the first sub-group of closure transceivers 120, 121 are arranged along the first side (depicted in FIG. 2) of the closure 210, and first sub-group of frame transceivers 130-132 are arranged on the first side of the closure frame 220. The other group of transceivers (e.g., transceivers 122, 123, 133-135 of FIG. 1) may be arranged on the second side of the closure 210 and closure frame 220 (not shown, on the opposite side of the closure 210 and closure frame 220 from the side shown in FIG. 2). However, operation of each respective sub-group of transceivers 120-123, 130-135 may be identical to detect obstacles on both sides of the closure 210. In further embodiments, similar additional transceivers may be provided in other locations, including along the top or bottom edges and/or the center of the closure 210.

In one exemplary embodiment, the transceivers 120, 121, 130-132 are arranged in a vertical row along the edge of the closure 210 and closure frame 230, respectively, as viewed when the closure 210 is closed. In other embodiments, the transceivers 120, 121, 130-132 may have different arrangements. In the discussion below, the transceivers 120, 121 are referred to as the first and second closure transceivers 120, 121, respectively, from top to bottom, and transceivers 130, 131, 132 are referred to as the first, second, and third frame transceivers 130, 131, 132, respectively, from top to bottom.

In the views of FIG. 2, the closure 210 is being closed and the system 100 has been initiated. The system 100 operates in one of two modes depending on the angle between the closure 210 and the frame 220. Generally, the system 100 operates in a first mode at relatively large angles (e.g., when the closure 210 is substantially open) and in a second mode at relatively small angles (e.g., when the closure 210 is almost closed). The system 100 may transition or switch between the modes at any suitable predetermined angle. The predetermined angle may be based on a number of factors, including the configuration and shape of the closure 210 and/or frame 220 and the capabilities of the transceivers 120, 121, 130-132. Generally, the angle is selected to provide the best lines of transmission between the transceivers 120, 121, 130-132 with a good signal to noise ratio within various conditions. The angle may be measured and provided to the controller 110 via the closure actuation unit 140. In other embodiments, a sensor may be provided to measure the angle of opening. Additional information about these modes will be provided below.

FIGS. 3-6 are schematic representations of the closure 210 at different angles, e.g., at different moments in time that are typical when closing the closure 210. FIGS. 3-6 also schematically depict closure transceivers 120, 121 and frame transceivers 130-132 on the first side, as in FIG. 2. As described below, the closure transceivers 120, 121 and frame transceivers 130-132 interact with one another to send and receive signals in any suitable way to evaluate the presence or absence of an obstacle within the closure path.

Typically each communication may be considered to include at least two signals, which may be referred to as a "burst." A first signal is generated by a transceiver 120, 121, 130-132 on a first side (e.g., either side) of the closure path and sent across the closure path. Upon reaching the other side of the closure path, in a first mode, the signal may be received by a "paired" transceiver 120, 121, 130-132 and returned back across the closure path, either relayed or otherwise corresponding to the first signal as a returned (or second) signal. In a second mode, the first signal may not be received by a paired transceiver 120, 121, 130-132. Instead, in the second mode, the first signal may be reflected off the vehicle, back across the closure path as the returned signal. Either way, the returned signal is received by a transceiver 120, 121, 130-132 on the first side of the closure path, e.g., either the transceiver 120, 121, 130-132 that sent the first signal or another transceiver 120, 121, 130-132 on the first side. The returned signal is provided to the controller 110. Interference between signals may be eliminated by designating the sending and receiving transceivers 120, 121, 130-132 such that, upon the sending of a first signal, the second signal is expected. This enables operation at a relatively high frequency. In one exemplary embodiment, the respective roles and timing of communication may be assigned by the controller 110. More detailed examples are discussed below.

As such, for every first signal of a burst, the controller 110 has an expected returned signal stored in the signal maps 112. As noted above, the signal maps 112 represent expected or anticipated reflected signals as an unobstructed closure frame according to the respective angle. The controller 110 compares the actual returned signal to the expected returned signal. If the signals match, the controller 110 concludes that no obstacle is present. On the other hand, if no signal is received or the signals do not match, it indicates that something is interrupting the signals, and the controller 110 concludes that an obstacle is within the closure path. In other words, the obstacle tends to attenuate and/or block a portion of the signals such that the returned signals do not match the expected signals corresponding to an unobstructed closure frame 220. Based on this comparison, the controller 110 determines the absence or existence of an obstacle in the closure path. The consequences of detecting an obstacle are discussed below after a description of each of FIGS. 3-6 with respect to sending and receiving signals.

Figure 3:
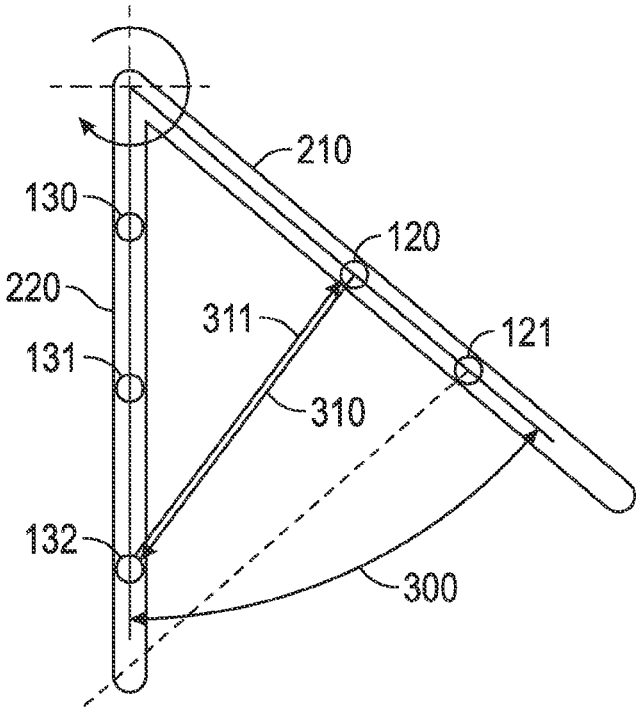
FIGS. 3-6 are schematic side views of portions of the obstacle detection system of FIG. 1 in accordance with an exemplary embodiment at different moments of time.
Figure 4:
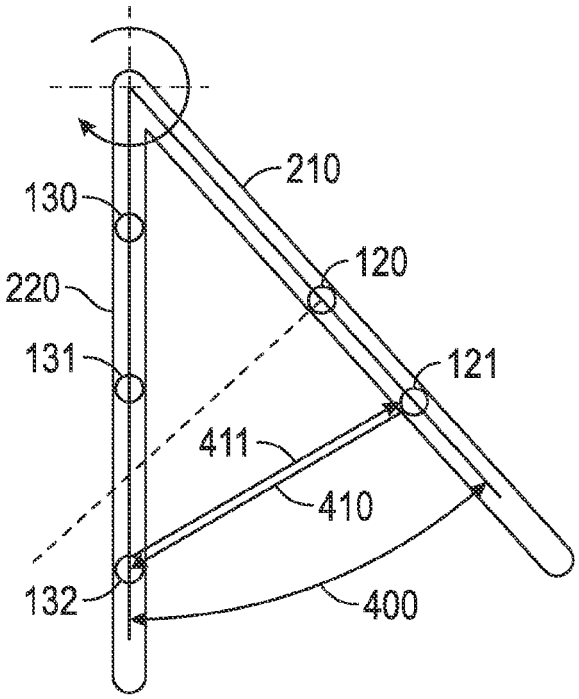

In the views of FIGS. 3 and 4, the closure 210 may be positioned at one or more angles such that the system 100 operates in the first mode. Typically, the first mode may be appropriate when the lines of site between transceivers 120, 121, 130-132 are more readily established and/or when the potential for impact is relatively low, as is appropriate for larger angles. As such, in the first mode at angles represented by the views of FIGS. 3 and 4, the closure transceivers 120, 121 are paired with frame transceivers 130-132 to send and receive signals.

Figure 5:
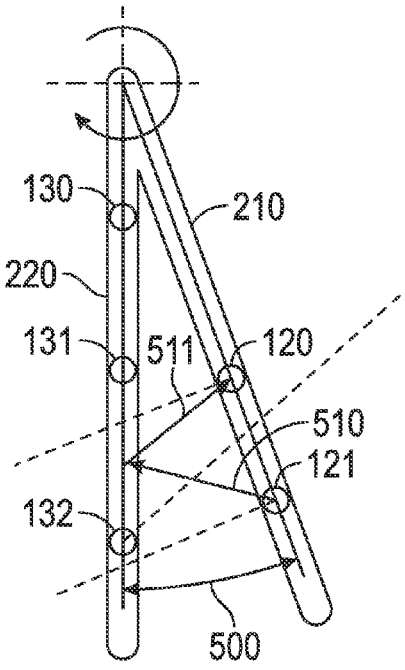
Figure 6:
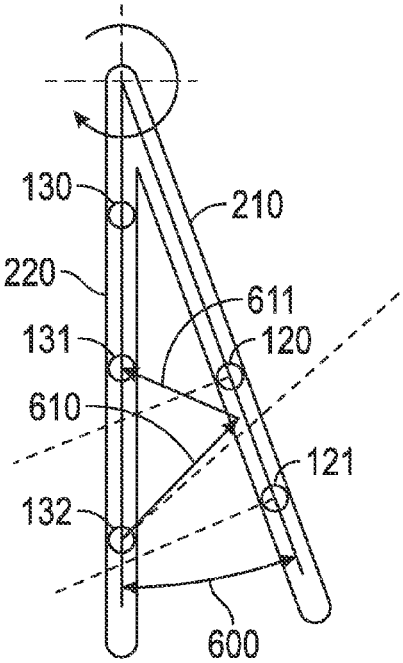

In the views of FIGS. 5 and 6, the closure 210 may be positioned at one or more angles such that the system 100 operates in the second mode. As noted above, the angles associated with the second mode are generally smaller than the angles associated with the first mode. Typically, the second mode may be appropriate when the lines of site between transceivers 120, 121, 130-132 may be more difficult to establish and/or when the chance of impact may be greater, as appropriate with smaller angles. As such, in the second mode at angles represented by the views of FIGS. 5 and 6, the closure transceivers 120, 121 are not paired with frame transceivers 130-132 and vice versa. As examples, exemplary lines of sight are depicted in FIGS. 5 and 6 as dashed lines. Instead, the transceivers 120, 121, 130-132 may send and receive signals that are reflected off the closure 210 or frame 220, as appropriate. Generally, the scenarios and operation of the system 100 with respect to the positions of FIGS. 3-6 described below are merely examples and variations may be provided.

Referring initially to FIG. 3, the closure 210 is opened relative to the closure frame 220 at a first angle 300. In this position, the first closure transceiver 120 has a line of site that may be aligned with the third frame transceiver 132. As such, the first closure transceiver 120 may be paired with the third frame transceiver 132. This pairing and any pairing discussed below may be automatic or predetermined based on the angle (e.g. the first angle 300), or the pairing may be the result of a "handshake" sent and received messages that establish the relationship.

In this embodiment, the first closure transceiver 120 sends a first signal 310 that is received by third frame transceiver 132. Subsequently, the third frame transceiver 132 sends a second (or returned) signal 311 that is received by the third frame transceiver 132 for evaluation by the controller 110, as detailed above.

As noted above, the relationship between the paired transceivers 120, 132 may be a result of advantageous lines of sight. Generally, an example of a line of sight for transceiver 121 is depicted as a dashed line, which, as shown, does not appear to intersect with any corresponding transceiver 130-132. However, depending on the situation, other relationships between the transceivers 120, 121, 130-132 may be established. For example, the third frame transceiver 132 may send the first signal that may be received and returned by the first closure transceiver 120. In other words, the send and receive roles may be reversed. Similarly, the signals may be sent and received by different transceivers. For example, the first closure transceiver 120 may send a first signal that is received by the third frame transceiver 132 that, in turn, sends a second message to the other closure transceiver 121. Similarly, the other frame transceivers 130, 131 may interact with the closure transceivers 120, 121. As noted above, the relationships may depend on any suitable parameter, including lines of sight and/or capabilities of the transceivers.

As a further example, FIG. 4 depicts the closure 210 and the frame 220 positioned at a second angle 400, which in this example, is less than the first angle 300, e.g. at a later point in time during the closing operation as compared to the position in FIG. 3. In the example of FIG. 4, the second closure transceiver 121 has a line of sight such that a first signal 410 is received by the third frame transceiver 132. In turn, the third frame transceiver 132 sends a second signal 411 that is received by the second closure transceiver 121 for evaluation. As such, the transceivers 120, 121, 130-132 may establish pairs or relationships as convenient or appropriate for the position of the closure 210. As above, the roles and interactions of the transceivers 120, 121, 130-132 may be modified, and generally, any number of such sent and received messages between the transceivers 120, 121, 130-132 may be used for evaluation.

Although FIGS. 3 and 4 are only two signal bursts, generally, in the first mode, the transceivers 120, 121, 130-132 sequentially send and receive signals from one another at a relatively high frequency. Accordingly, the signals are modulated, coordinated, and/or sequential between the transceivers 120, 121, 130-132 to provide improved obstacle detection. As such, in one exemplary embodiment, the vector signal beams are sent sequentially in accordance with a sequential interlaced beaming algorithm for long range detection.

Referring now to FIG. 5, the closure 210 may be positioned relative to the frame 220 at an angle 500 such that the system 100 operates in the second mode. In this example, the second closure transceiver 132 sends a first signal 510 that is reflected off of the frame 220, and the reflected or second signal 511 is received by the first closure transceiver 132 for evaluation by the controller 110, as detailed above. In contrast to the situations of FIGS. 3 and 4, the closure transceivers 120, 121 are not paired with the frame transceivers 130-132. Although FIG. 5 depicts a scenario in which the second signal 511 is received by the first closure transceiver 120, in some embodiments, the second signal 511 may be reflected towards, and received, by the second closure transceiver 121. Generally, transceivers may send and receive reflected signals in various combinations.

Referring now to FIG. 6, the closure 210 may be positioned relative to the frame 220 at an angle 600 such that the system 100 is still operating in the second mode. Relative to the position in FIG. 5, the angle 600 in FIG. 6 is less than the angle 500 of FIG. 5. In this example, the third frame transceiver 132 sends a first signal 610 that is reflected off of the closure 210, and the reflected or second signal 611 is received by the second frame transceiver 131 for evaluation. As above, other roles and relationships for sending and receiving reflected signals may be provided. Generally, operation in the second mode may provide a more "dense" supervision of sent and received signals in situations in which the closure 210 is relatively close to the closure frame 220.

Generally, in either mode, in one exemplary embodiment, the controller 110 may be able to determine the absence or existence of an obstacle in the closure path based on one burst of signals received at a single transceiver 120-123, 130-135. However, the controller 110 typically considers a number of such bursts from various transceivers 120-123, 130-135, which may reduce noise and provide a higher level of confidence in the accuracy of the determination.

Regarding noise, in one exemplary embodiment, the controller 110 operates the transceivers 120-123, 130-135 according to the principle of modulated interlaced beaming. Generally, solar light, body paint and other perturbing factors may result in noise that influences a hypothetical analog response. To avoid such occurrences, the transceivers 120-123, 130-135 may generate short burst of modulated IR (or other type of carrier) and the designated receiving transceiver 120-123, 130-135 records the amplitude of the response for each of these bursts. As one example, a carrier frequency of approximately 33-40 KHz may be used. Noise associated with changing ambient light level may be accommodated and/or considered by measure of the level of ambient light when no signal is being transmitted and subtracting this value from the measured response.

In one exemplary embodiment, the transceivers 120-123, 130-135 may communicate according to an "interlaced handshake" as a principle of noise/error rejection originating in digital communication networks where the receiver is resending to the transmitter a coded number that would be checked against the "intended" value, e.g., upon a mismatch, it is recognized that the receiver knows it did not receive the intended burst sequence and requests a repeated occurrence. Since the closure moves relatively slow (e.g., on the order of seconds) and several such re-negotiation are possible with limited concerns of timing. In effect, the implementation of "returned" code of the intended reflection is verified by reversing the transmitter with the receiver in a respective transceiver 120-123, 130-135 following every burst sequence.

If no obstacle is detected, the controller 110 typically takes no action and the closure 210 continues to close along the closure path. If an obstacle is detected, the controller 110 may take action, such as sending an appropriate signal to the closure actuation unit 140 or the warning unit 150. The closure actuation unit 140 may stop or reverse the movement of the closure 210 to prevent the closure 210 from contacting the obstacle. The warning unit 150 may generate a warning, such as a visual warning or an audible signal to alert the user of the obstacle. In some embodiments, the controller 110 may take no action. The response of the controller 110 may depend on the position of the closure 210. For example, at greater angles 230, the controller 110 is less likely to take action and/or is more likely to generate a warning instead of reversing or stopping the closure 210.

In one exemplary embodiment, the controller 110 may take a different action during the second mode as compared to the corresponding action during the first mode. For example, upon detection of an obstacle in the first mode, the controller 110 may generate a warning (e.g., because the closure 210 is relatively wide open, giving the user an opportunity to remove the obstacle), and upon detection of an obstacle in the second mode, the controller 110 may command reversal of the closure 210 (e.g. because the closure 210 is almost closed).

Figure 7:
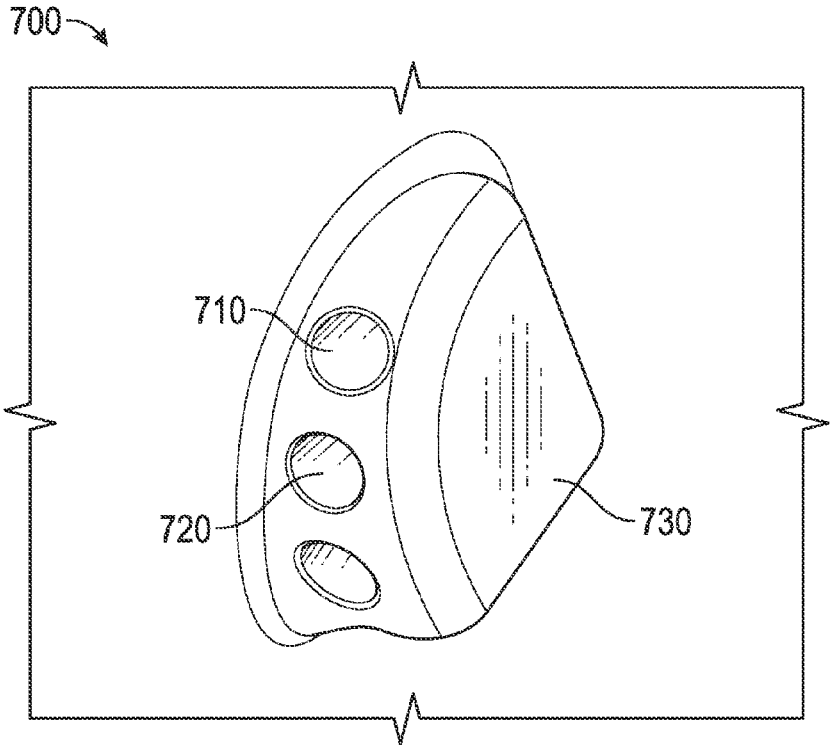
FIG. 7 is a isometric view of a transceiver used in the obstacle detection system of FIG. 1 in accordance with an exemplary embodiment.

FIG. 7 is a transceiver 700 that may be used in the system 100 discussed above. For example, the transceiver 700 may correspond to the transceivers 120-123, 130-135 of FIGS. 1-6. As shown in FIG. 7, the transceiver 700 may include a transmitter 710 and a receiver 720 arranged within a common housing 730. As also noted above, the transceivers 700 may be embodied as a single device that encapsulates both the transmitter 710 and receiver 720. The housing 730 of such transceivers 700 may be designed and mounted as appropriate for décor and function. In one exemplary embodiment, the transceivers 700 are snapped into a cutout on the body of the closure or closure frame.

Figure 8:
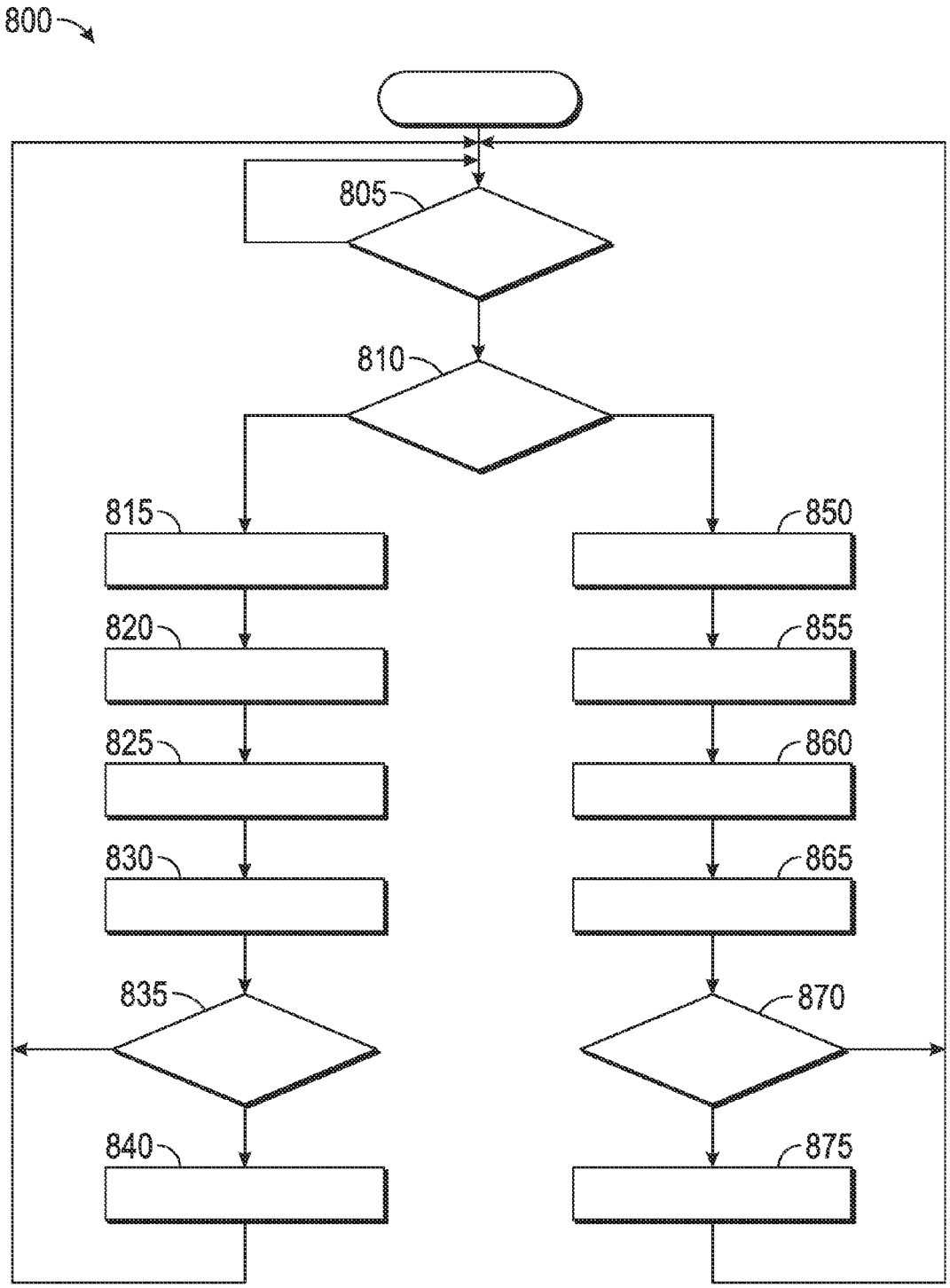
FIG. 8 is a flow chart of a method for detecting an obstacle in the path of a vehicle closure.

FIG. 8 is a flow chart of a method 800 for detecting an obstacle in the path of a vehicle closure. The method 800 may be implemented with the system 100 of FIG. 1 and the assembly 200 of FIGS. 2-6, which are referenced below in the discussion of method 800.

In a first step 805, the status of the system 100 is evaluated to determine if the system 100 is active. As noted above, the system 100 is typically active when the closure 210 is being closed. In a second step 810, the closure angle 230 is evaluated. If the angle 230 is within a relatively higher range, the method 800 proceeds to step 815 in which the system 100 operates in the first mode. If the angle 230 is within a relatively lower range, the method 800 proceeds to step 850 in which the system 100 operates in the second mode.

Referring initially to the first mode in step 815, in the subsequent step 820, the transceivers 120-123, 130-135 sequentially send signals from a first side of the closure path, which are typically received by paired transceivers 120-123, 130-135 on the other side of the closure path and returned. In step 825, the transceivers 120-123, 130-135 on the first side typically receive the returned signals. Steps 820 and 825 are generally coordinated such that various transceivers 120-123, 130-135 alternately send and receive signals from other transceivers 120-123, 130-135. In step 830, the controller 110 compares the returned signals to the signal maps 112. In step 835, the controller 110 determines if an obstacle is present according to the comparison. If no obstacle is present, the method 800 returns to the initial step 805. If an obstacle is present, the method 800 proceeds to step 840 in which a response is initiated. As described above, the response may vary based on the mode and may include a warning or actuation of the closure 210. Upon initiating the response, the method 800 returns to the initial step 805.

Referring now to the second mode in step 850, in the subsequent steps 855 and 860, the transceivers 120-123, 130-135 send and receive signals reflected from across the closure path. In step 865, the controller 110 compares the returned signals to the signal maps 112. In step 870, the controller 110 determines if an obstacle is present according to the comparison. If no obstacle is present, the method 800 returns to the initial step 805. If an obstacle is present, the method 800 proceeds to step 875 in which a response is initiated. As described above, the response may vary based on the mode and may include a warning or actuation of the closure 210. Upon initiating the response, the method 800 returns to the initial step 805.

Accordingly, exemplary embodiments provide improved systems and methods for detecting obstacles within the path of a closure. The transceivers provide relatively low cost, high accuracy, reliable, and non-contact detection of obstacles. Exemplary embodiments eliminate the need for side object detection (SOD) carriers and sensors.

Techniques and technologies may be described herein in terms of functional and/or logical block components and various processing steps. It should be appreciated that such block components may be realized by any number of hardware, software, and/or firmware components configured to perform the specified functions. For example, an embodiment of a system or a component, such as a control system, may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments may be practiced in conjunction with any number of data transmission protocols and that the system described herein merely illustrates one suitable example.

For the sake of brevity, conventional techniques related to near field detection, control systems operation, automotive operation, closure operation, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the subject matter.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An obstacle detection system for a closure assembly of a vehicle with a first closure structure and a second closure structure that define a closure path, the obstacle detection system comprising:

a first group of transceivers mounted on the first closure structure;

a second group of transceivers mounted on the second closure structure; and a controller coupled to the first and second groups of transceivers and configured to selectively operate the first and second groups of the transceivers in a first mode or a second mode based on an angle of opening of the closure assembly, the controller configured to, during operation in the first mode, command the first group of transceivers to generate a first signal across the closure gap toward the second group of transceivers, command, upon the second group of transceivers receiving the first signal, the second group of transceivers to generate a second signal to be received by the first group of transceivers, and determine a presence or absence of an obstacle in the closure path based on the second signal, the controller configured to, during operation in the second mode, command the first group of transceivers to generate a third signal across the closure gap such that the third signal is reflected off the second closure structure as a fourth signal to be received by the first group of transceivers, and determine the presence or absence of the obstacle in the closure path based on the fourth signal.

2. The obstacle detection system of claim 1, wherein the first closure structure is a closure, the first group of transceivers is a first group of closure transceivers, the second closure structure is a closure frame, and the second group of transceivers is a first group of frame transceivers.

3. The obstacle detection system of claim 1, wherein the first closure structure is a closure frame, the first group of transceivers is a first group of frame transceivers, the second closure structure is a closure, and the second group of transceivers is a first group of closure transceivers.

4. The obstacle detection system of claim 1, wherein controller is configured to modulate the generation of the first signal for each of the first group of transceivers based on time.

5. The obstacle detection system of claim 1, wherein the first group of transceivers includes a first transceiver and a second transceiver, and wherein the controller commands the first group of transceivers such that the first transceiver generates the first signal and the second transceiver receives the second signal.

6. The obstacle detection system of claim 1, wherein the first group of transceivers includes a first transceiver and a second transceiver, and wherein the controller commands the first group of transceivers such that the first transceiver generates the first signal and the first transceiver receives the second signal.

7. The obstacle detection system of claim 1, wherein the first group of transceivers includes a first transceiver and a second transceiver, and wherein the controller commands the first group of transceivers such that, at a first angle of opening, the first transceiver generates the first signal and the second transceiver receives the second signal and, at a second angle of opening, the first transceiver generates the first signal and the first transceiver receives the second signal.

8. The obstacle detection system of claim 1, wherein the first group of transceivers includes a first transceiver and a second transceiver and the second group of transceivers includes a third transceiver and a fourth transceiver, and wherein the controller commands the first and second groups of transceivers such that, at a first angle of opening in the first mode, the first transceiver generates the first signal to be received by the third transceiver and, at a second angle of opening in the first mode, the first transceiver generates the first signal to be received by the fourth transceiver.

9. The obstacle detection system of claim 1, wherein the controller is configured to operate in the first mode when an angle between the closure and the closure frame is within a first range and to operate in the second mode when the angle between the closure and the closure frame is within a second range, the first range being greater than the second range.

10. The obstacle detection system of claim 1, wherein the controller stores signal maps associated with an unobstructed closure path, and wherein the controller is configured to determine the presence or absence of the obstacle between the closure and the closure frame by comparing the second or fourth signals to at least one of the signal maps.

11. The obstacle detection system of claim 1, wherein the controller, upon detection of the obstacle during the first mode, initiates a first response and, upon detection of the obstacle during the second mode, initiates a second response.

12. The obstacle detection system of claim 11, wherein the first response is different from the second response.

13. The obstacle detection system of claim 11, wherein the first response and the second response include at least one of a warning and actuation of the closure.

14. The obstacle detection system of claim 1, wherein the closure is a rear lift gate.

15. A closure assembly, comprising:

a first closure structure;

a second closure structure arranged relative to the first closure structure to define a closure path;

a first group of transceivers mounted on the first closure structure;

a second group of transceivers mounted on the second closure structure; and a controller coupled to the first and second groups of transceivers and configured to selectively operate the first and second groups of the transceivers in a first mode or a second mode based on an angle of opening between the first and second closure structures, the controller configured to, during operation in the first mode, command the first group of transceivers to generate a first signal across the closure gap toward the second group of transceivers, command, upon the second group of transceivers receiving the first signal, the second group of transceivers to generate a second signal to be received by the first group of transceivers, and determine a presence or absence of an obstacle in the closure path based on the second signal, the controller configured to, during operation in the second mode, command the first group of transceivers to generate a third signal across the closure gap such that the first signal is reflected off the second closure structure as a fourth signal to be received by the first group of transceivers, and determine the presence or absence of the obstacle in the closure path based on the fourth signal.

16. The closure assembly of claim 15, wherein the first closure structure is a closure, the first group of transceivers is a first group of closure transceivers, the second closure structure is a closure frame, and the second group of transceivers is a first group of frame transceivers.

17. The closure assembly of claim 15, wherein the first closure structure is a closure frame, the first group of transceivers is a first group of frame transceivers, the second closure structure is a closure, and the second group of transceivers is a first group of closure transceivers.

18. The closure assembly of claim 15, wherein controller is configured to modulate the generation of the first signal for each of the first group of transceivers based on time.

19. The closure assembly of claim 15, wherein the first group of transceivers includes a first transceiver and a second transceiver, and wherein the controller commands the first group of transceivers such that, at a first angle of opening, the first transceiver generates the first signal and the second transceiver receives the second signal and, at a second angle of opening, the first transceiver generates the first signal and the first transceiver receives the second signal.

20. A method for detecting an obstacle in a closure path of a closure assembly of a vehicle with a first closure structure and a second closure structure that define the closure path with a closure gap when at least partially open, the method comprising the steps of:

selecting a first mode of operation or a second mode of operation based a closure angle between the first and second closure structures;

transmitting, in the first mode, a first signal from a first group of transceivers mounted on the first closure structure across the closure gap toward a second group of transceivers mounted on the second closure structure, wherein at least a first transceiver of the first group of transceivers and at least a second transceiver in the second group of transceiver form a first paired set of transceivers across the closure gap in the first mode, and wherein the transmitting, in the first mode, includes transmitting the first signal directly from the first transceiver to the second transceiver;

receiving, in the first mode, the first signal by the second group of transceivers, including receiving directly, in the first mode, the first signal by the second transceiver;

transmitting, in the first mode, a second signal by the second group of transceivers across the closure gap toward the first group of transceivers including transmitting directly, in the first mode, the second signal by the second transceiver;

receiving, in the first mode, the second signal by the first group of transceivers including receiving directly, in the first mode, the second signal by the first transceiver;

determining, in the first mode, a presence or absence of an obstacle in the closure path based on the second signal;

transmitting, in the second mode, a third signal from the first group of transceivers across the closure gap such that the third signal is reflected off the second closure structure as a fourth signal;

receiving, in the second mode, the fourth signal by the first group of transceivers; and determining, in the second mode, the presence or absence of the obstacle based on the second signal.

* * * * *